US011219838B2

(12) United States Patent
Forgrave

(10) Patent No.: US 11,219,838 B2
(45) Date of Patent: Jan. 11, 2022

(54) USER CONTROLLABLE MARBLE RUN KIT

(71) Applicant: Global Family Brands, LLC, Indianapolis, IN (US)

(72) Inventor: Jeffrey David Forgrave, Indianapolis, IN (US)

(73) Assignee: Global Family Brands, LLC, Indianapolis, IN (US)

( * ) Notice: Subject to any disclaimer, the term of this patent is extended or adjusted under 35 U.S.C. 154(b) by 0 days.

(21) Appl. No.: 16/878,514

(22) Filed: May 19, 2020

(65) Prior Publication Data

US 2020/0276505 A1 Sep. 3, 2020

Related U.S. Application Data

(63) Continuation of application No. 15/639,984, filed on Jun. 30, 2017, now Pat. No. 10,653,970.

(51) Int. Cl.

| | |
|---|---|
| ***A63H 18/00*** | (2006.01) |
| ***A63F 9/14*** | (2006.01) |
| ***A63H 33/26*** | (2006.01) |
| ***A63H 33/08*** | (2006.01) |
| ***A63F 7/26*** | (2006.01) |
| ***A63F 7/36*** | (2006.01) |
| ***A63F 7/30*** | (2006.01) |

(52) U.S. Cl.

CPC ..... *A63H 18/00* (2013.01); *A63F 7/26* (2013.01); *A63F 7/3075* (2013.01); *A63F 7/3622* (2013.01); *A63H 33/08* (2013.01); *A63H 33/26* (2013.01); *A63F 2007/3662* (2013.01); *A63F 2250/52* (2013.01)

(58) Field of Classification Search

CPC ..... A63H 18/00; A63H 18/02; A63H 18/023; A63H 33/08; A63H 33/26; A63F 7/26; A63F 7/3075; A63F 7/3622; A63F 2007/3662; A63F 2250/52

USPC ..... 446/168; 463/69; 273/118 R

See application file for complete search history.

(56) References Cited

U.S. PATENT DOCUMENTS

| | | | | | |
|---|---|---|---|---|---|
| 1,576,140 | A * | 3/1926 | Schneider | A63F 7/3622 | 273/120 R |
| 4,153,250 | A * | 5/1979 | Anthony | A63F 7/02 | 273/120 A |
| 4,713,038 | A * | 12/1987 | Wichman | A63F 7/02 | 446/168 |
| 4,874,342 | A * | 10/1989 | Klitsner | A63F 7/3622 | 446/168 |

(Continued)

*Primary Examiner* — Alexander R Niconovich

(74) *Attorney, Agent, or Firm* — Maginot, Moore & Beck LLP

(57) ABSTRACT

A method of operating a marble run includes providing first input through a user interface to a wireless device. The method further includes using the wireless device to transmit a first wireless control signal to a wireless receiver disposed on a marble run responsive at least in part to receiving the first input. The marble run includes a plurality of physically interconnectable marble run modules, each module configured to retain a marble and guide the travel of the marble through the module on at least a first surface. The plurality of marble run modules includes at least a first controllable module. The method further includes using the first controllable module to alter a travel path of a marble through the first controllable module responsive to the wireless receiver receiving the first wireless control signal.

20 Claims, 6 Drawing Sheets

(56) References Cited

U.S. PATENT DOCUMENTS 4,932,917 A * 6/1990 Klitsner ..... A63F 7/3622 446/168
5,007,876 A * 4/1991 Klitsner ..... A63F 7/3622 446/168
5,312,285 A * 5/1994 Rieber ..... A63F 7/3622 273/109
5,451,177 A * 9/1995 Gilman ..... A63F 7/3622 446/128
5,785,573 A * 7/1998 Rothbarth ..... A63F 7/3622 446/171
5,800,240 A * 9/1998 Jackson ..... A63F 7/3622 446/120
5,908,343 A * 6/1999 Rothbarth ..... A63F 7/3622 446/171
6,074,269 A * 6/2000 Rothbarth ..... A63F 7/3622 238/10 R
6,536,763 B1 * 3/2003 Braun ..... A63F 7/3622 273/118 R
6,733,361 B1 * 5/2004 Rudell ..... A63H 17/00 238/1 OE
6,945,839 B2 * 9/2005 Quercetti ..... A63H 18/06 104/123
7,618,302 B2 * 11/2009 Collins ..... A63H 18/02 446/168
7,819,720 B2 * 10/2010 Nuttall ..... A63H 18/08 446/444
8,154,227 B1 * 4/2012 Young ..... A63H 30/04 318/255
8,608,527 B2 * 12/2013 O'Connor ..... A63H 18/02 446/444
8,734,201 B2 * 5/2014 Nuttall ..... A63H 18/025 446/444
8,944,881 B2 * 2/2015 Payne ..... A63H 18/028 446/444
9,418,517 B1 * 8/2016 Davis ..... G07F 17/3202
9,956,493 B1 * 5/2018 Hunts, Jr. ..... A63H 33/046
2002/0034982 A1 * 3/2002 Mejia ..... A63F 7/3622 463/69
2003/0082985 A1 * 5/2003 Payne ..... A63H 17/44 446/15
2007/0209543 A1 * 9/2007 Beaulieu ..... A63F 7/3622 104/53
2009/0084863 A1 * 4/2009 Sorenson ..... A63F 7/3622 238/122
2011/0070803 A1 * 3/2011 Hoffman ..... A63F 7/3622 446/168
2011/0269369 A1 * 11/2011 O'Connor ..... A63H 18/028 446/429
2013/0045656 A1 * 2/2013 Aigner ..... A63H 19/24 446/175
2013/0320619 A1 * 12/2013 Hornsby ..... A63F 7/3622 273/118 R
2019/0038963 A1 * 2/2019 Forgrave ..... A63F 7/3622
2020/0054954 A1 * 2/2020 Forgrave ..... A63H 33/08

* cited by examiner

USER CONTROLLABLE MARBLE RUN KIT

This application is a continuation of U.S. patent application Ser. No. 15/639,984, filed Jun. 30, 2017, which is incorporated herein by reference in its entirety.

FIELD OF THE INVENTION

The present invention is related to building toys, and more specifically, kits for designing and building marble run tracks.

BACKGROUND

Marble run toys known in the art have interconnecting track sections that may be arranged by a user in any of a plurality of designs. Once constructed, the track can define a downhill track through the various sections or modules. The interchangeable nature of the various module designs allow for the construction of many different marble run layouts.

FIG. 1 shows an exemplary marble run layout 10 formed of a plurality of interconnecting modules 11A, 11B, 11C, 11D, 11E, 11F and 18. The modules may take many forms, such as modules 11A, 11B and 11C, which include channels 12 that laterally direct a marble from a vertical receiving tube 14 to an exit tube 16. The channels 12 may define circuitous routes, such as those modules 11B and 11C. Other modules comprise vertical tubes 18 that can be used as part of the track, or merely as vertical support structures for other modules. Still other modules 11D can include a wide platform 20 with spikes 22 to direct the ball in an unpredictable path from the vertical receiving tube 24 and the exit tube 26. Other modules 11E can include a bowl structure. Modules having additional or alternative features are also known.

In popular marble run kits, the vertical receiving tube 14 of each module is generally designed to directly physically connect to an exit tube 16 of an upstream module, thus allowing the marble to transition downstream from module to module. In FIG. 1, most of the receiving tubes 14 are disposed within part of the exit tube 16 of an upstream module, and therefore is not in view. The modules may have other tubes or structures 28 under the vertical receiving tube 14 to allow that portion of the module to be supported from below, for example, by vertical tube modules 18. Similarly, the modules may have a bypass tube 30 disposed vertically above the exit tube 16 that may provide support as well as an alternative marble input.

Like many construction toys, the marble run kits currently available allow for creative play by enabling the user to construct the marble run (or multiple runs) in a multitude of configurations. Unlike many construction toys, however, the marble run kits have the added advantage providing an animated feedback of the player's design via movement of the marble. Accordingly, marble run kits have enjoyed pervasive success.

It would be advantageous to create a toy kit that builds on the advantages of the marble run kits while preserving the appealing aspects of the original design.

SUMMARY

At least one embodiment described herein contemplates a marble run kit wherein one or more marble run modules have controllable actuators that can alter the course of a marble within the run. Such an embodiment allows for the user not only to design the marble run, but affect its operation. In some embodiments, the control is remote, for example, using wireless infrared or Bluetooth transmission.

A first embodiment of the invention is a method of operating a marble run includes providing first input through a user interface to a wireless device. The method further includes using the wireless device to transmit a first wireless control signal to a wireless receiver disposed on a marble run responsive at least in part to receiving the first input. The marble run includes a plurality of physically interconnectable marble run modules, each module configured to retain a marble and guide the travel of the marble through the module on at least a first surface. The plurality of marble run modules includes at least a first controllable module. The method further includes using the first controllable module to alter a travel path of a marble through the first controllable module responsive to the wireless receiver receiving the first wireless control signal.

The above-described features and advantages, as well as others, will become more readily apparent to those of ordinary skill in the art by reference to the following detailed description and accompanying drawings.

DETAILED DESCRIPTION

An exemplary embodiment of the invention is a marble run kit that includes a plurality of physically interconnectable marble run modules. Each module is configured to retain a marble and guide the travel of the marble through the module on at least a first surface. One or more of the marble modules is a controllable module, as will be discussed below, while others may suitably be traditional passive modules, for example, such as those shown in FIG. 1. However, it will be appreciated that the passive modules may have designs that differ from those shown in FIG. 1.

Figure 2A:
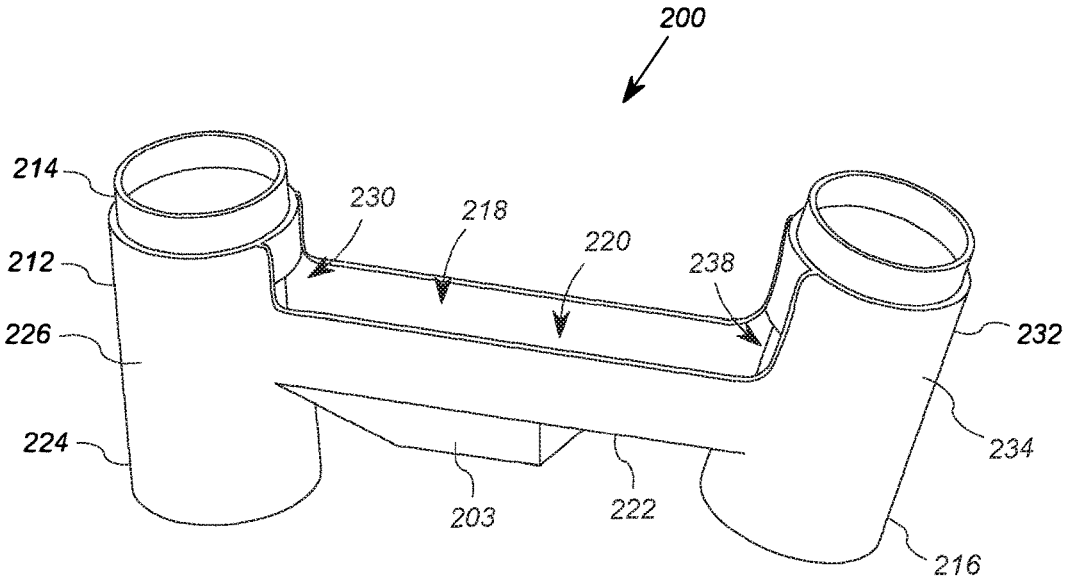
FIG. 2A shows a perspective view of a first controllable module that may be employed in a marble run kit.
Figure 2B:
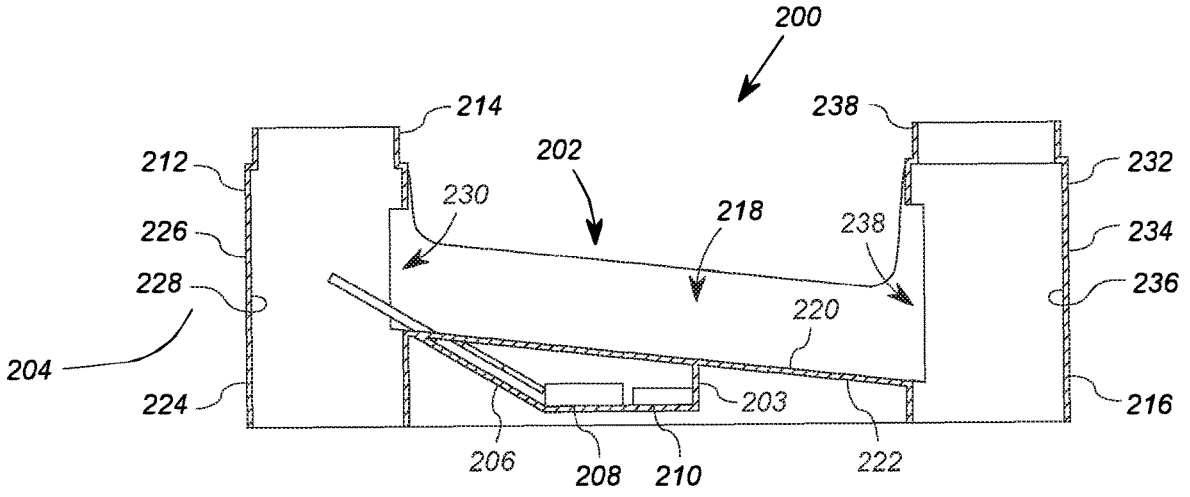
FIG. 2B shows a cutaway view of the first controllable module in the first configuration.
Figure 2C:
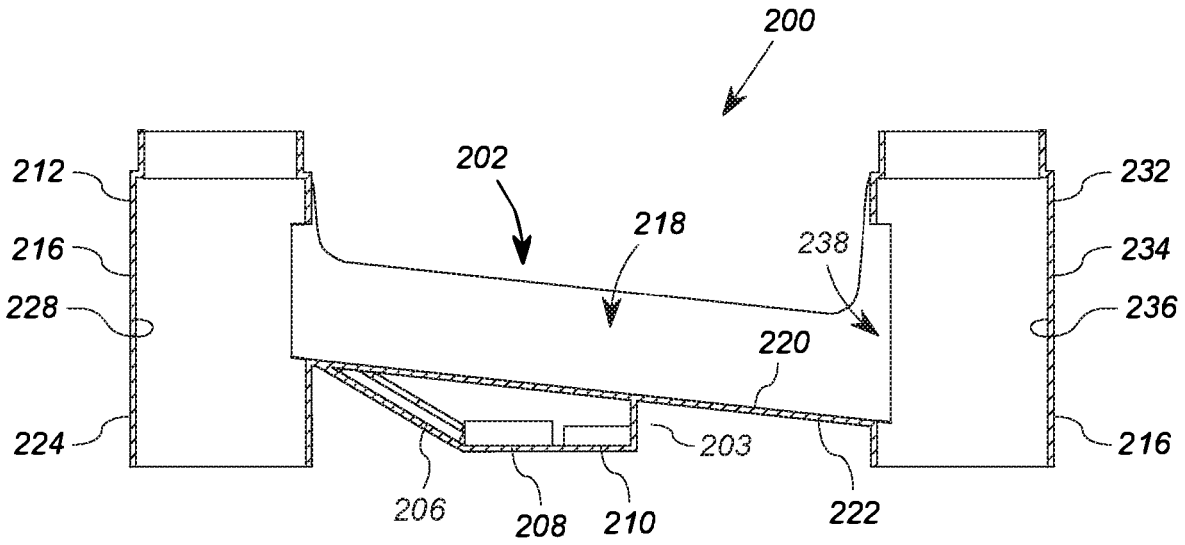
FIG. 2C shows a cutaway view of the first controllable module in the second configuration.

FIGS. 2A, 2B and 2C illustrate a first embodiment of a controllable module 200 that may be used in a marble run kit according to the present invention. FIG. 2A shows a perspective view of the module 200, FIG. 2B shows a sectional view of the controllable module 200 with the module in a first configuration, and FIG. 2C shows a sectional view of the controllable module 200 with the module in a second configuration.

With contemporaneous references to FIGS. 2A, 2B and 2C, the controllable module 200 includes an interconnectable track base 202, a baffle 204, an actuator 206, wireless receiver circuitry 208, and a power source 210. The track base 202 includes a vertical receiving tube 212, an exit tube 216, and a travel region 218. The vertical receiving tube 212 includes a connecting portion 214 configured to directly physically connect to a corresponding exit tube of an upstream module. For example, the connecting portion 214 may suitably connect to any of the exit tubes 16 of FIG. 1. The vertical receiving tube 212 is configured to receive a suitable marble from such corresponding exit tube. The exit tube 216 of the module 200 is configured to directly physically connect to a corresponding vertical receiving tube of a downstream module. For example, the exit tube 216 is configured to connect to vertical receiving tube 14 of any of the modules 11 of FIG. 1.

The travel region 218 is in this embodiment a sloped, lateral, u-shaped marble channel configured to receive and guide a corresponding, suitable marble. A marble channel, as used herein, is a channel having a cross-sectional size and shape sufficient to retain a marble therein while a marble travels through the channel. The u-shaped marble channel of the travel region 218 has a cross-sectional diameter that is less than twice the diameter of a marble intended for use with the kit. In general, the marble channel of the travel region 218 includes a marble receiving surface 220 and an opposite bottom surface 222, defining a thickness therebetween. The travel region 218 is configured to retain and guide the marble from the vertical receiving tube 212 to the exit tube 216. The receiving surface 220 of the channel slopes downward from the receiving tube 212 to the exit tube 216 to allow the marble to advance via gravity.

The track base 202 further includes a second exit tube 224 disposed below the receiving tube 212. The second exit tube 224 is configured to attach to a corresponding receiving tube of another module, such as any of the modules of FIG. 1, or other controllable modules 400, 500, 600 discussed further below. The receiving tube 212 and the second exit tube 224 thereby form a continuous vertical tube 226 having an interior 228. The continuous vertical tube 226 includes a side opening 230 through which a marble may travel from the interior 228 of the tube 226 to the receiving surface 220 of the travel region 218.

The track base 202 also includes a second vertical receiving tube 232 disposed above the exit tube 216. The second vertical receiving tube 232 is configured to attach to a corresponding exit tube of another module, such as any of the modules 11A, 11B, 11C, 11D, 11E or 18 of FIG. 1, or other controllable modules 400, 500, 600 discussed further below. The exit tube 216 and the second vertical receiving tube 232 thereby form a second continuous vertical tube 234 having an interior 236. The second continuous vertical tube 234 includes a side opening 238 through which a marble may travel from the receiving surface 220 of the travel region 218 to the interior 236 of the tube 224, and thus through the exit tube 216.

The track base 202 is also configured to support and/or provide a mounted housing 203 for the baffle 204, the actuator 206, the wireless receiver circuitry 208, and the power source 210. The baffle 204 in this embodiment is a retractable plate or rod that has a first position (FIG. 2B), and a second position (FIG. 2C). The baffle 204 is configured to direct the marble within the module 200 in different directions based on whether the baffle 204 is in the first position or the second position. In particular, the baffle 204 in the first position extends in an inclined manner at least in part through bottom surface 222 and top surface 220 of the travel region 218 and into the interior 228 of the vertical tube 226. In this position a marble received through the vertical receiving tube 212 is directed by the baffle 204 to the travel region 218 through the opening 230. In the second position, the baffle 204 is retracted at least partially out of the interior 228, and at least to a degree sufficient to allow a suitable marble to pass from the receiving tube 212 to and out of the second exit tube 224. In the retracted second position, most of the baffle 204 is disposed below the top surface of the travel region 218 and at least partly below the bottom surface 222 of the travel region 218.

The actuator 206 in this embodiment is a linear actuator mounted directly or indirectly on the bottom surface 222 of the track base 202. The actuator 206 is operably connected to move the baffle 204 between the first position and the second position responsive at least in part to control signals. For example, the actuator 206 is configured to move the baffle 204 from the first position to the second position in response to a first control signal, and is configured to move the baffle 204 from the second position to the first position in response to a second control signal. In another embodiment, the actuator 206 may be configured to move the baffle 204 from its current position to the other position based on a single control signal, regardless of whether the current position is the first position or the second position. Linear actuators of sufficient size are commercially available.

Figure 3:
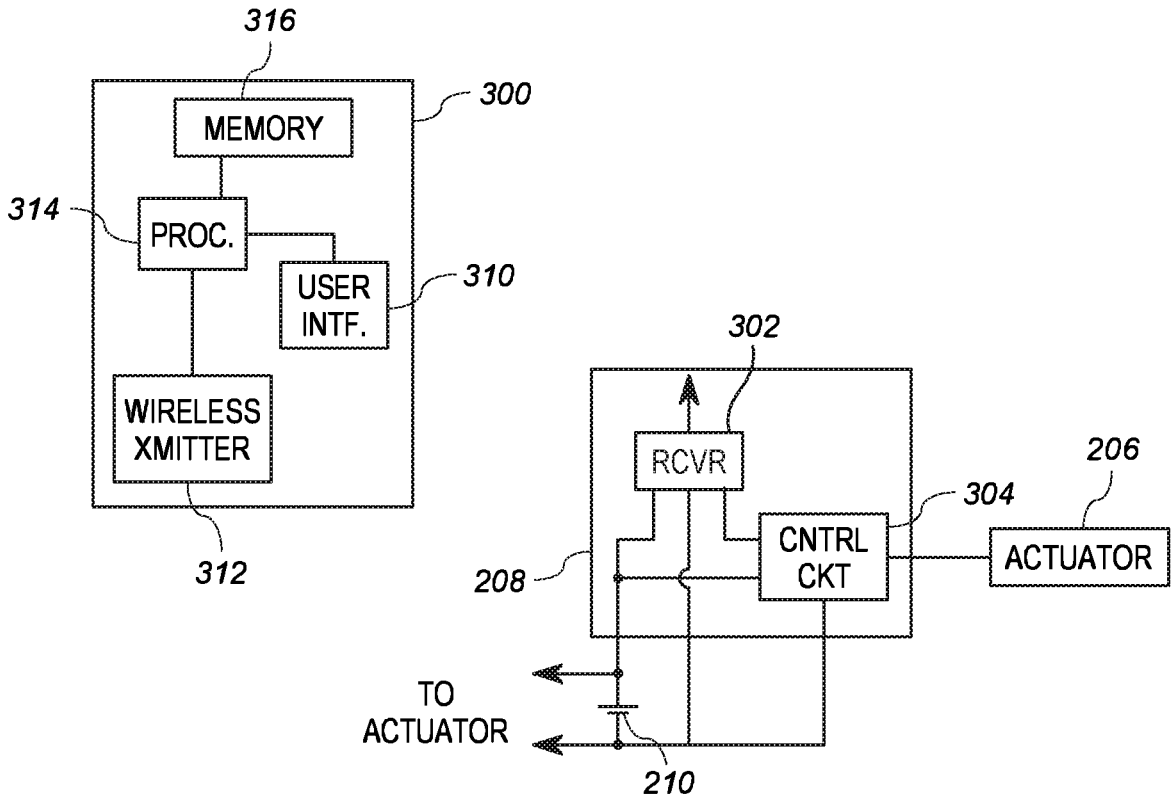
FIG. 3 shows an exemplary schematic diagram of the control elements of the first controllable module in context with an external control transmitter.

The wireless receiver circuit 208 is also mounted within the housing 203 directly or indirectly on and below the bottom surface 222 of the travel region 218 of the track base 202. The wireless receiver circuit 208 is shown schematically in context in FIG. 3. More specifically, FIG. 3 shows a schematic diagram of the wireless receiver circuit 208, the actuator 206, the power source 210, and an external control transmitter 300. The external control transmitter 300 is a device through which a user may remotely control the position of the baffle 204 of the controllable module 200.

As shown in FIG. 3, the wireless receiver circuit 208 includes a receiver 302, a control circuit 304. The receiver 302 may suitably be an infrared receiver, or a Bluetooth-enabled receiver. The receiver 302 is operably coupled to the control circuit 304, and indeed may be part of the same integrated package. The receiver 302 is configured to receive wireless signals and generate information therefrom. The control circuit 304 is operably coupled to receive information from the receiver 302, and is configured to selectively generate the first and second control signals based on information received from the receiver 302. The control circuit 304 is operably coupled to provide the first and/or second control signals to the actuator 206. The power source 210, which may suitably be a 3.0 volt disk battery, is operably connected to provide power to the receiver 302, the control circuit 304, and the actuator 206.

The control transmitter 300 is a remote control device that includes a user interface 310, a wireless transmitter circuit 312, as well as other elements not shown. The user interface 310 includes an input mechanism to allow the user to provide as input command information. The wireless transmitter circuit 312 is configured to generate and transmit command information to the receiver 302 based on the input information from the user. The control transmitter 300 also includes a processor 314 configured to execute programming instructions, stored in memory 316, to perform operations attributed to the processor 314 herein, among other things.

The control transmitter 300 may suitably be a wireless "smart" phone, or other handheld wireless computing device with Bluetooth and/or infrared transmitting capability. Thus, the user interface 310 in some embodiments is the user interface of a handheld wireless computing device, e.g. a touch screen device. In such a case, the wireless transmitter circuit 312 may suitably be a Bluetooth transmitter.

Referring again to FIGS. 2A, 2B, 2C and 3, an exemplary operation of the controllable module 200 is described. The controllable module 200 may suitably be assembled as a part of a marble track similar to that shown by way of example in FIG. 1. In the first configuration, the baffle 204 is in the first position as shown in FIG. 2B, extending into the interior 228 of the tube 226. In this position, a marble can be received via the vertical receiving tube 212 and pass through the opening 230 to the travel region 218. Once in the travel region 218, the marble rolls over the surface 220 and through the opening 238 into the vertical tube 234. The marble then drops via gravity through the exit tube 216. If there is another module connected to the exit tube 216, then the marble enters that tube.

However, a user, not shown, may enter input into the control transmitter 300 containing an instruction to retract the baffle 204 into the second position as shown in FIG. 2C. To this end, the user interface 310 of FIG. 3 receives the input. Responsive to the input, the processor 314 causes the wireless transmitter to transmit a first wireless signal to the receiver circuit 208. The first wireless signal contains information that indicates an address or identification value associated with the receiver circuit 208, and command information associated with retracting the baffle 204. It will be appreciated that in a track with multiple controllable modules, each module will have a unique address or identifier. In such a case, the user must also enter a selection input indicating the desired module to command, as well as the instruction input discussed above. The processor 314 receives such selection input and generates the address information of the first wireless signal accordingly.

Figure 1:
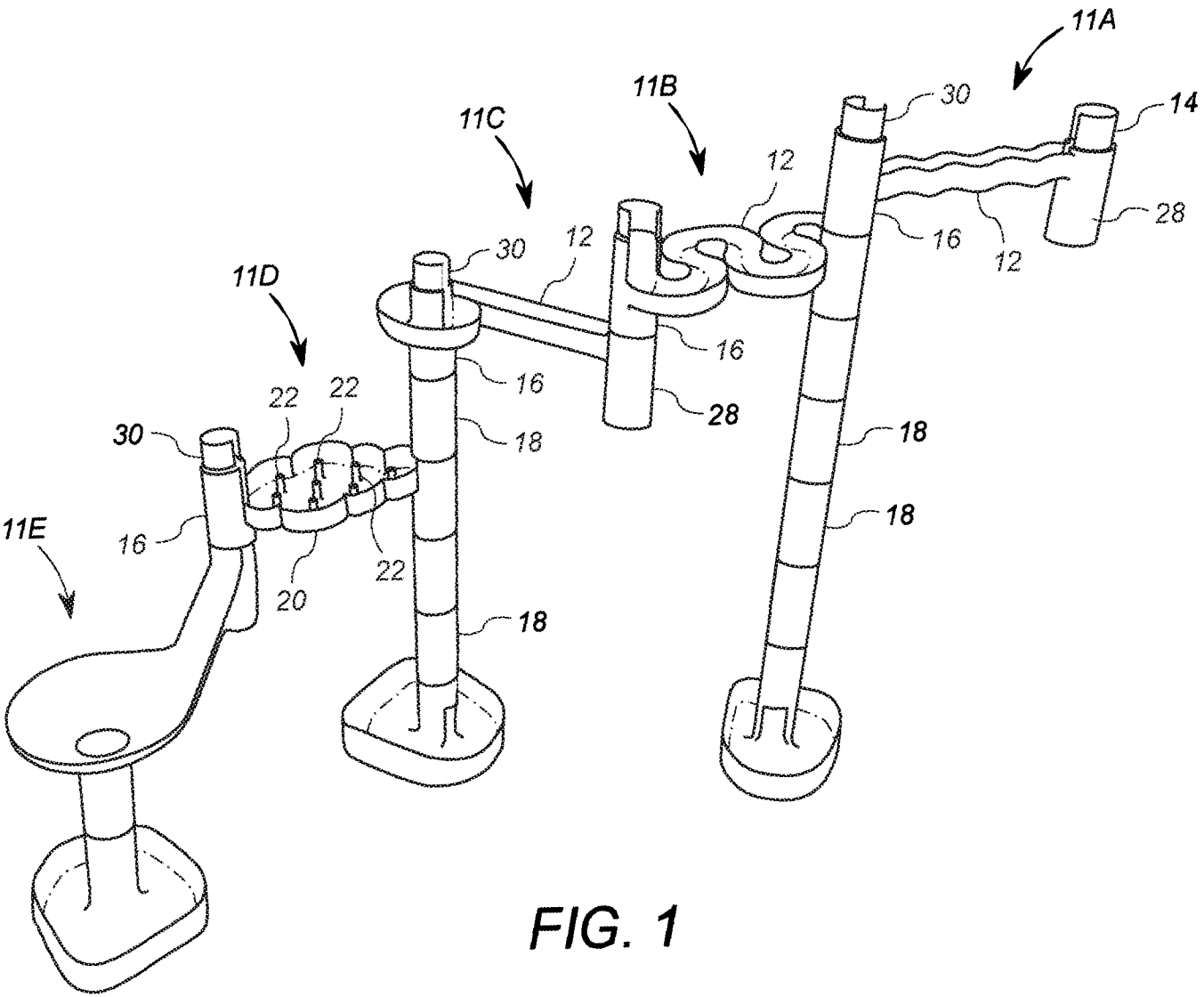
FIG. 1 shows a perspective view of an exemplary marble run formed from at least part of a prior art marble run kit.

The wireless receiver circuit 208 receives the signal, and determines whether the address information corresponds to its own address or identification value, indicating that the message is intended for it. Specifically, the receiver 302 receives the wireless signal, and the receiver 302 and control circuit 304 cooperate to identify whether the address information in the received signal indicates that the signal is intended for this particular device. If not, then the message is discarded and nothing further occurs. If so, however, then the control circuit 304 obtains the command information from the received message. If the command information has a value that corresponds to retracting the baffle 204, then the control circuit 304 sends a first signal to the actuator 206 that causes the actuator 206 to retract the baffle 204. The actuator 206 then retracts the baffle 204. With the baffle 204 in the retracted or second position, as shown in FIG. 1, a marble entering the vertical receiving tube 212 falls unimpeded to and out of the second exit tube 224.

To return the baffle 204 to the first position, the user can enter an input into the control transmitter 300 containing an instruction to extend the baffle 204 into the first position as shown in FIG. 2B. As before, the user interface 310 of FIG. 3 receives the input, and may also receive input identifying the controllable module 200 as the module to be controlled. Responsive to the input, the processor 314 causes the wireless transmitter to transmit a second wireless signal to the receiver circuit 208. The second wireless signal contains information that indicates an address or identification value associated with the receiver circuit 208, and command information associated with extending the baffle 204 into the first position.

The wireless receiver circuit 208 again receives the signal, and determines whether the address information corresponds to its own address or identification value, indicating that the message is intended for it. If the signal is addressed to the module 200 (wireless receiver circuit 208), then the control circuit 304 obtains the command information from the received message. If the command information has a value that corresponds to extending the baffle 204, then the control circuit 304 sends a second signal to the actuator 206 that causes the actuator 206 to extend the baffle 204. The actuator 206 then extends the baffle 204. With the baffle 204 in the extended or first position, as shown in FIG. 2B, a marble entering the vertical receiving tube 212 is directed by the baffle 204 out of the tube 226 through the opening 230. The marble then rolls down the travel region 218, into the tube 234, and out of the exit tube 216.

Accordingly, it can be seen that a user may use the control transmitter 300, such as a programmed smart phone or similar wireless computing device, to determine whether a marble entering the module 200 will exit through the exit tube 216 or the second exit tube 224. In a marble run track having several modules, such as those shown in FIG. 1, it can be seen how the track may be designed to have two different branches—one extending from the exit tube 216, and one extending from the second exit tube 224. The branches may or may not reconnect.

It will be appreciated that the control transmitter 300 may be programmed to generate and send the wireless transmitter immediately upon receiving the user input. In the alternative, the control transmitter 300 may subsequently execute the user input command as part of programmed sequence controlling multiple modules. In another embodiment, the processor 314 may be programmed to randomly send out the first wireless signal or second wireless signal to create different marble run outcomes as a matter of chance. Similarly, the processor 314 may be programmed to allow the user to send the first and/or second wireless signal upon completion of a gaming task running on the control transmitter 300. For example, the user may have to solve a puzzle or answer a question after the marble starts in the track, and would be able to alter its course if the user can solve the puzzle or answer the question on the control transmitter 300 before the marble reaches the input tube 212. It will be appreciated that many other variants that employ the control of the controllable module 200 can be envisioned for gaming and/or educational purposes.

It can also be seen that the arrangement of the baffle 204, actuator 206, wireless circuit 208, and power source 210 may readily be incorporated into the various modules 11A, 11B, 11C, 11D, and 11E, as they all include a vertical receiving tube 14 and a laterally displaced exit tube 16. In such cases, the structural tube 28 disposed below the vertical receiving tube 14 would be configured as a second exit tube, and the baffle 204, actuator 206, wireless circuit 208 and power source 210 would be arranged as otherwise described above.

Figure 4A:
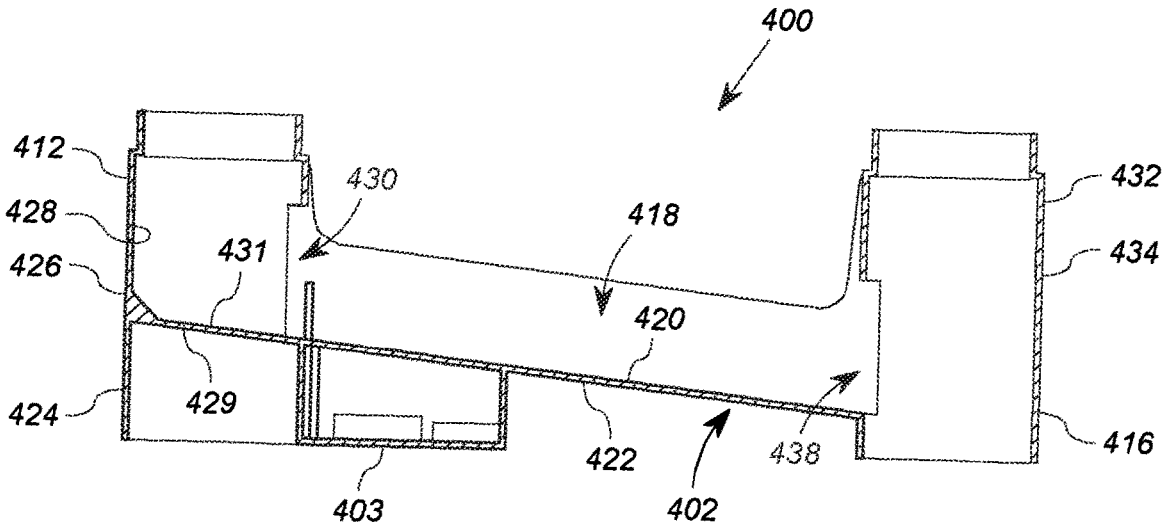
FIG. 4A shows a cutaway view of an exemplary second controllable module according to the invention in a first configuration.
Figure 4B:
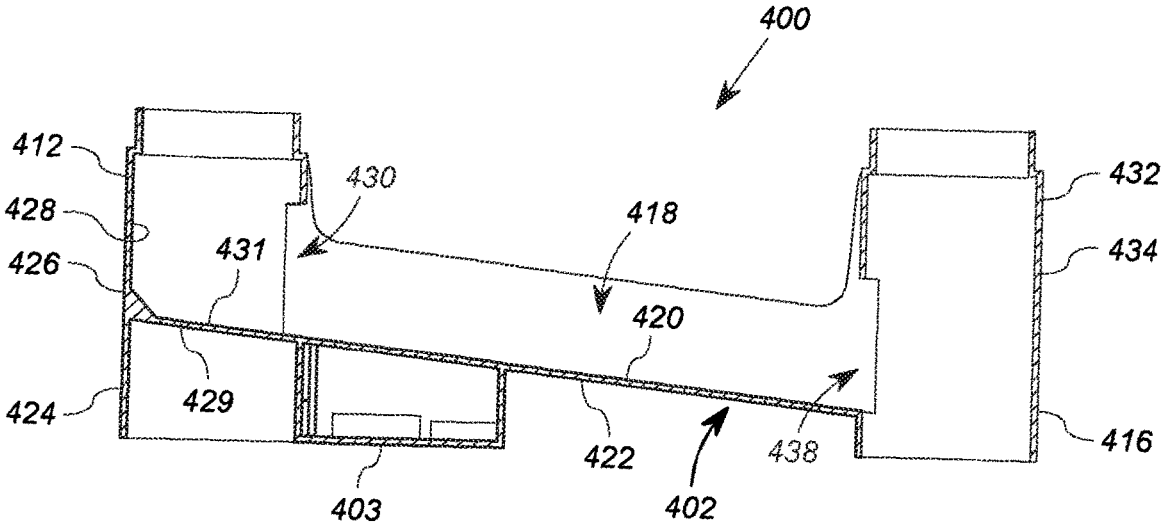
FIG. 4B shows a cutaway view of the second controllable module in the second configuration.

The concept of providing a user control options in a marble run toy may be implemented through other controllable module designs. FIGS. 4A and 4B, by way of example, illustrate another controllable module 400 that is implemented in a different way than that of FIGS. 2A, 2B and 2C.

FIG. 4A shows a sectional view of the controllable module 400 with the module in a first configuration, and FIG. 4B shows a sectional view of the controllable module 400 with the module in a second configuration. In this embodiment, the controllable module 400 in the first configuration operates as a temporary roadblock, or obstruction, that prevents further movement of the marble 400.

With contemporaneous references to FIGS. 4A and 4B, the controllable module 400 includes an interconnectable track base 402, a baffle 404, an actuator 406, wireless receiver circuitry 408, and a power source 410. The track base 402 may suitably be substantially similar to that shown in FIG. 2A. To this end, the track base 402 includes a vertical receiving tube 412, an exit tube 416, and a travel region 418 that are substantially identical in structure to, respectively, the vertical receiving tube 212, an exit tube 216, and a travel region 218 of the controllable module 200.

The track base 402, however, includes a structural tube 424 that differs from the second exit tube 224 of FIG. 2A because it does not allow a marble to pass straight through in any configuration. In particular, the structural tube 424 is disposed vertically below the receiving tube 412 and is configured to directly attach to a corresponding receiving tube of another module, such as any of the modules of FIG. 1, or other controllable modules discussed further below. The receiving tube 412 and the structural tube 424 thereby form a continuous, but obstructed, vertical tube 426 having an interior 428. The vertical tube 426 includes a side opening 430 through which a marble may travel from the interior 428 of the tube 426 to the receiving surface 420 of the travel region 418. Unlike the continuous vertical tube 226 of FIG. 2, the vertical tube 426 includes a permanent obstruction 429 extending across the interior, such as a flat or curved platform. The obstruction 429 is configured to direct a marble falling from the receiving tube 412 out of the side opening 430 into the receiving surface 420 of the travel region 418. The obstruction 429 has an inclined upper surface 431 to provide a downhill race toward opening 430.

The track base 402 also includes a second vertical receiving tube 432 disposed above the exit tube 416, substantially identical in structure and function to the second vertical receiving tube 232 of FIGS. 2A, 2B and 2C. As such, the exit tube 416 and the second vertical receiving tube 432 form a continuous vertical tube 434 that includes a side opening 438 through which a marble may travel from the receiving surface 420 of the travel region 418 into the tube 434 and out of the exit tube 416.

The track base 402 is also configured to support and/or provide a housing 403 to mount the baffle 404, the actuator 406, the wireless receiver circuitry 408, and the power source 410. The baffle 404 in this embodiment is a retractable plate or rod that has a first position (FIG. 4A), and a second position (FIG. 4B). The baffle 404 is configured to prevent the marble from advancing through the travel region 418 to the exit tube 416 in the first position (FIG. 4A), and to allow the marble to pass to the exit tube 416 in the second position (FIG. 4B).

In particular, in this embodiment, the baffle 404 in the first position extends vertically upward at or near the opening 430 to prevent the marble from exiting the vertical tube 426. It will be appreciated that the baffle 404 need not extend solely vertically upward, so long as there is a substantial vertical component to its travel. In the first position, a marble received through the vertical receiving tube 412 is retained completely or partly in the interior 428 of the tube 426. To this end, the baffle 404 extends higher than (stands proud of) marble receiving surface 431 of the obstruction 429 to trap the marble. The baffle 404 need not extend to a height above the surface 431 equivalent the diameter of the marble, but rather need only extent to a height sufficient to prevent the marble from advancing. In fact, by implementing a first position of the baffle 404 that is less than a marble diameter, then the size of the baffle 404 that needs to be retracted in the second position is advantageously reduced.

In the second position, the baffle 404 is retracted vertically downward, such it does not prevent the marble from traveling out of the opening 430 after fall through the vertical receiving tube 412. To this end, the baffle 404 may retract to a position such that the highest point of the baffle 404 is below the lowest part of the receiving surface 431 of the obstruction 429, as illustrated in FIG. 4B.

The actuator 406 in this embodiment is a linear actuator mounted directly or indirectly on the bottom surface 422 of the track base 402. The actuator 406 may be substantially similar in structure and function to the actuator 206 of FIGS. 2A, 2B, and 2C, except that it is oriented to extend and retract the baffle 404 primarily vertically, while the actuator 206 is mounted to move the baffle 204 at a slight incline.

The actuator 406 is configured to move the baffle 404 from the first position to the second position in response to a first control signal, and is configured to move the baffle 404 from the second position to the first position in response to a second control signal.

The wireless receiver circuit 408 is also mounted directly or indirectly on and below the bottom surface 422 of the travel region 418 of the track base 402. The wireless receiver circuit 408 may suitably have the same circuitry as that shown in FIG. 3, including a receiver 302 and a control circuit 304. The control circuit 304 in this embodiment is operably coupled to provide the first and/or second control signals to the actuator 406. However, the control circuit 304 in this embodiment is configured to provide the first control signal to the actuator 406 after a predetermined delay period after providing the second control signal to the actuator 406. The power source 410, which may suitably be a 3.0 volt disk battery, is operably connected to provide power to the receiver 302, the control circuit 304, and the actuator 406.

The control transmitter 300 in this embodiment is configured to generate and transmit different control information than that used in the embodiment of FIGS. 2A, 2B, and 2C. In this embodiment, the processing circuit 314 is configured to generate command information that identifies a delay period. The delay period identifies the time that the user wishes to hold the baffle 404 in the first position (FIG. 4A). As will be discussed further below, however, other embodiments may employ a preprogrammed delay period that is not controllable by the user. Still other embodiments may allow the user to control the baffle 404 in a manner similar to that used in the embodiment of FIGS. 2A, 2B and 2C, wherein the user controls each transition between the first and second positions separately.

Referring again to FIGS. 4A, 4B and 3, an exemplary operation of the controllable module 400 is described. The controllable module 400 may suitably be assembled as a part of a marble track that includes modules shown in FIG. 1. The default configuration for the controllable module 400 is the second configuration, with the baffle 404 retracted, as shown in FIG. 4B. In this position, a marble can be received via the vertical receiving tube 412 and pass through the opening 430 to the travel region 418. Once in the travel region 418, the marble rolls over the surface 420 and through the opening 438 into the vertical tube 434. The marble then drops via gravity through the exit tube 416. If there is another module connected to the exit tube 416, then the marble enters that tube.

However, a user, not shown, may enter input into the control transmitter 300 containing an instruction to temporarily extend the baffle 404 into the first position as shown in FIG. 4A, in order to delay the travel of the marble. To this end, the user interface 310 of FIG. 3 receives the input, as well as input identifying the specific module 400. In this embodiment, the user may also provide information to the user interface 310 identifying the length of delay, e.g. in seconds. Responsive to the input, the processor 314 causes the wireless transmitter to transmit a second wireless signal to the receiver circuit 408. The second wireless signal contains information that indicates an address or identification value associated with the receiver circuit 408, and command information associated with temporarily extending the baffle 404.

The wireless receiver circuit 408 receives the signal, and determines whether the address information corresponds to its own address or identification value, indicating that the message is intended for it. Specifically, the receiver 302 of FIG. 3 receives the wireless signal, and the receiver 302 and control circuit 304 cooperate to identify whether the address information in the received signal indicates that the signal is intended for this particular device. If not, then the message is discarded and nothing further occurs. If so, however, then the control circuit 304 obtains the command information from the received message. If the command information has a value that corresponds to temporarily extending the baffle 404, then the control circuit 304 sends a first signal to the actuator 406 that causes the actuator 406 to extend the baffle 404 into the first position (FIG. 4A). The control circuit 304 in this embodiment also extracts from the command information the delay length set by the user. After the predetermined time identified in the extracted command information, the control circuit 304 sends the second signal to the actuator 406 that causes the actuator to retract the baffle 404 into the second position (FIG. 4B).

If the delay is not user programmable, then the control circuit 304 may employ a preprogrammed delay before causing the actuator 406 to retract the baffle. Moreover, as discussed above, the control circuit 304 may, instead of automatically causing the baffle 404 to be retracted after a delay, cause the baffle 404 to be retracted after receiving a subsequent signal from the control transmitter 300, similar to the embodiment of FIGS. 2A, 2B and 2C.

Accordingly, it can be seen that a user may use the control transmitter 300, such as a programmed smart phone or similar wireless computing device, to halt progress of the marble through the controllable module 400, either with a preprogrammed delay, a user selected delay, or until the user sends a subsequent command to retract the baffle 404. As with the controllable module 200, the control transmitter 300 may be programmed to generate and send the wireless transmitter upon receiving the user input, or subsequently, as part of programmed sequence controlling multiple modules, for example.

Figure 5A:
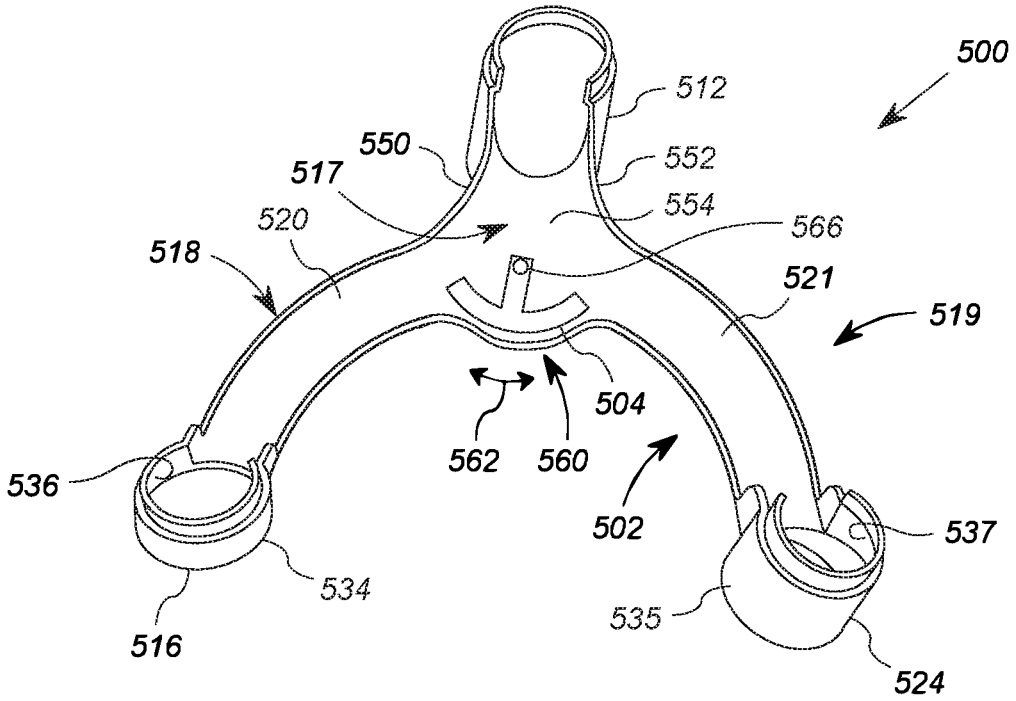
FIG. 5A shows to perspective view of an exemplary third controllable module according to the invention in a first configuration.
Figure 5B:
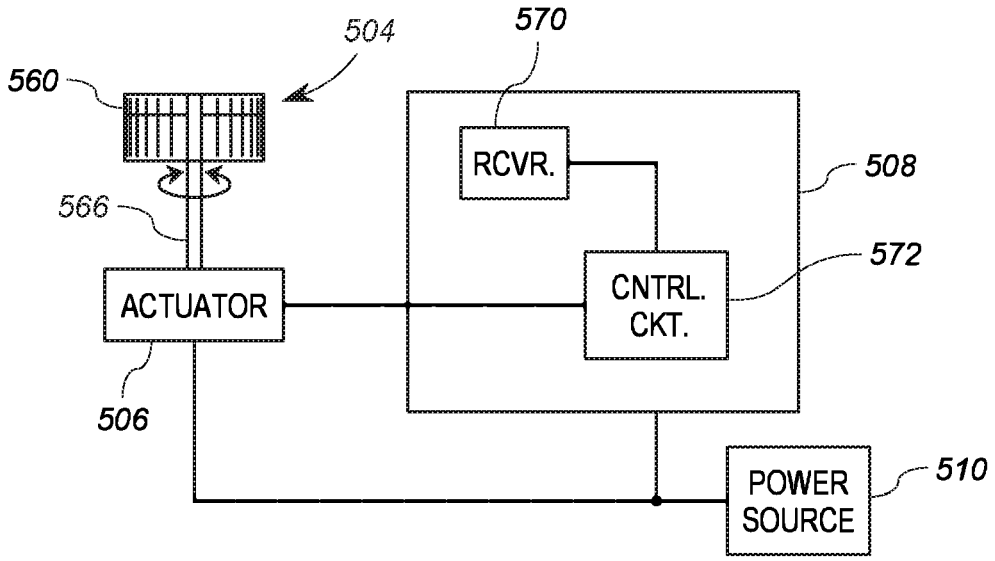
FIG. 5B shows an exemplary schematic diagram of the control elements of the third controllable module.

Another embodiment of a controllable module 500 that may be used in a marble run kit according to the present invention is shown in FIGS. 5A and 5B. FIG. 5A shows a top perspective view of the module 500, and FIG. 5B shows a schematic view of operating elements of the controllable module 500 without the track base 502.

With contemporaneous reference to FIGS. 5A and 5B, the controllable module 500 includes an interconnectable track base 502, a baffle 504, an actuator 506, wireless receiver circuitry 508, and a power source 510. The track base 502 includes a vertical receiving tube 512, first and second exit tubes 516, 524, a fork section 517, and first and second travel regions 518, 519. The vertical receiving tube 512 is substantially identical in structure and function to the vertical receiving tube 412 of FIGS. 4A and 4B, and is configured to connect to (and receive a marble from) an exit tube of another module, not shown. The first exit tube 516 of the module 500 is configured to directly physically connect to a corresponding vertical receiving tube of a downstream module. The second exit tube 524 is configured to directly physically connect to a separate vertical receiving tube of a downstream module.

Each of the travel regions 518, 519 is in this embodiment a lateral, u-shaped marble channel configured to receive a corresponding, suitable marble. To this end, each of the travel regions 518, 519 includes a respective marble travel surface 520, 521. The cross-section of the travel regions may suitably be identical to that of the travel region 218 of the module 200. The fork section 517 is also a marble receiving structure that includes short side walls 550, 552, and a bottom surface 554. The bottom surface 554 forms a continuous marble-receiving surface with each of the marble travel surfaces 520, 521. The fork section 517 extends from the vertical receiving tube 512 to each of the first and second travel regions 518, 519. The first travel region 518 is configured to retain and guide the marble from the fork section 517 to the first exit tube 516. The second travel region 519 is configured to retain and guide the marble from the fork section 517 to the second exit tube 524.

The first exit tube 516 forms a continuous vertical tube 534 having an interior 536 substantially identical in structure and function to the continuous tube 234 of FIGS. 2A, 2B and 2C. Similarly, the second exit tube 524 forms a continuous vertical tube 535 having an interior 537 substantially identical in structure and function to the continuous tube 234 of FIGS. 2A, 2B and 2C. Each of the vertical tubes 534, 535 includes a side opening through which a marble may travel from the respective receiving surface 520, 521 to the respective interiors 536, 537, and thus through the corresponding exit tubes 516, 524.

The track base 502 is also configured to support and/or provide a mount for the baffle 504, the actuator 506, the wireless receiver circuitry 508, and the power source 510. The baffle 504 in this embodiment includes a moveable member 560 rigidly coupled to a pivoting element 566. The actuator 506 is configured to rotate the pivoting element 566 to move the baffle 504 between the first position and the second position. The baffle 504 is configured to direct the marble within the module 500 in different directions based on whether the baffle 504 is in the first position or the second position. In particular, the baffle 504 in the first position, shown in FIG. 5A, is configured to direct a marble within the fork section 517 to the second travel region 519. To this end, when the moveable member 560 rotates toward the left (toward the first travel region 518), it creates a path wall that urges the marble toward and into the second travel region 519. Contrariwise, the baffle 504 in the second position, not shown, is configured to direct the marble within the fork section 517 into the first travel region 518. To this end, when the moveable member 560 rotates toward the right (toward the second travel region 519), it creates a path wall that urges the marble toward to the first travel region 518. It will be appreciated that the moveable member 560 can take multiple shapes the form the required path wall when rotated into the two positions.

The actuator 506 in this embodiment is a rotating actuator mounted directly or indirectly on the bottom surface, not shown, of the track base 502. In this embodiment, the actuator 506 is preferably mounted to the bottom of the track base 502 at least in part directly below the fork section 517. The actuator 506 is operably connected to move the baffle 504 between the first position and the second position responsive at least in part to control signals. For example, the actuator 506 is configured to move the baffle 504 from the first position to the second position in response to a first control signal, and is configured to move the baffle 504 from the second position to the first position in response to a second control signal. In another embodiment, the actuator 506 may be configured to move the baffle 504 from its current position to the other position based on a single control signal, regardless of whether the current position is the first position or the second position. Suitable actuators for mounting to the bottom of the track base would be known to those of ordinary skill in the art.

Although not visible in the drawings, the wireless receiver circuit 508 is also mounted directly or indirectly on and below the bottom surface beneath the fork section 517 of the track base 502. As shown in FIG. 5B, the wireless receiver circuit 508 includes a receiver 570 and a control circuit 572. The receiver 570 may suitably be identical in structure and function to the receiver 302 of FIG. 3. The control circuit 572 is operably coupled to receive information from the receiver 570, and is configured to selectively generate the first and second control signals based on information received from the receiver 570. The control circuit 570 is operably coupled to provide the first and/or second control signals to the actuator 506. The power source 510, which may suitably be a 3.0 volt disk battery, is operably connected to provide power to the receiver 570, the control circuit 572, and the actuator 506.

In operation, the controllable module 500 may suitably be assembled as a part of a marble track that includes modules such as those shown in FIG. 1. In the first configuration, the baffle 504 is in the first position as shown in FIG. 5A, pivoted toward the first travel section 518 to create a marble path from the fork section 517 to the second travel section 519. In this position, a marble can be received via the vertical receiving tube 512 and pass through an opening in the tube 512 to the fork section 517. The path wall formed by the moveable member 560 guides the marble into the second travel region 519. Once in the travel region 519, the marble rolls downhill over the surface 521 and into the vertical tube 535. The marble then drops via gravity through the exit tube 524. If there is another module connected to the exit tube 524, then the marble enters that module.

However, a user, not shown, may enter input into the control transmitter 300 of FIG. 3 containing an instruction to rotate the baffle 504 into the second position. To this end, the user interface 310 of FIG. 3 receives the input, as well as input identifying the control module 500. Responsive to the input, the processor 314 causes the wireless transmitter 312 to transmit a first wireless signal to the receiver circuit 508. The first wireless signal contains information that indicates an address or identification value associated with the receiver circuit 508, and command information associated with moving the baffle 504 into the second position.

The wireless receiver circuit 508 receives the signal, and determines whether the address information corresponds to its own address or identification value, indicating that the message is intended for it. Specifically, the receiver 570 receives the wireless signal, and the receiver 570 and control circuit 572 cooperate to identify whether the address information in the received signal indicates that the signal is intended for this particular device. If not, then the message is discarded and nothing further occurs. If so, however, then the control circuit 572 obtains the command information from the received message. If the command information has a value that corresponds to moving the baffle 504 to the second position, then the control circuit 572 sends a first signal to the actuator 506 that causes the actuator 506 to rotate the baffle 504 toward the second travel section 518. The actuator 506 then rotates the baffle 504 using the pivoting member 566 toward the second travel section 519 into the second position.

With the baffle 504 in the second position, a marble received via the vertical receiving tube 512 and passing to the fork section 517 will be guided by the path wall formed by the moveable member 560 into the first travel region 518. Once in the travel region 518, the marble rolls downhill over the surface 520 and into the first vertical tube 534. The marble then drops via gravity through the first exit tube 516. If there is another module connected to the first exit tube 516, then the marble enters that module.

To return the baffle to the first position, the user can enter an input into the control transmitter 300 (see FIG. 3) containing an instruction to rotate the baffle 504 back into the first position as shown in FIG. 5A. As before, the user interface 310 of FIG. 3 receives the input, and may also receive input identifying the controllable module 500 as the module to be controlled. Responsive to the input, the processor 314 causes the wireless transmitter 312 to transmit a second wireless signal to the receiver circuit 508. The second wireless signal contains information that indicates an address or identification value associated with the receiver circuit 508, and command information associated with rotating the baffle 504 into the first position.

The wireless receiver circuit 508 again receives the signal, and determines whether the address information corresponds to its own address or identification value, indicating that the message is intended for it. If the signal is addressed to the module 500 (wireless receiver circuit 508), then the control circuit 572 obtains the command information from the received message. If the command information has a value that corresponds to moving the baffle 504 into the first position, then the control circuit 572 sends a second signal to the actuator 506 that causes the actuator 506 to rotate the pivoting element 566 in the direction that moves the moveable member 560 towards the first travel region 518. The actuator 506 then rotates the baffle 504 accordingly. With the baffle 504 in the first position, as shown in FIG. 5A, a marble entering the vertical receiving tube 512 and fork section 517 is directed by the moveable member 560 towards the second travel region 519. The marble then rolls down the second travel region 519, into the second vertical tube 535, and out of the exit tube 524.

Accordingly, it can be seen that a user may use the control transmitter 300, such as a programmed smart phone or similar wireless computing device, to determine whether a marble entering the module 500 will travel down the first travel region 518 (and exit through the exit first tube 516), or travel down the second travel region 519 (and exit through the second exit tube 524). It will be appreciated that the control transmitter 300 may be programmed to generate and send the wireless transmitter immediately upon receiving the user input. Alternatively, the control transmitter 300 may transmit signals as part of programmed sequence controlling multiple modules. As discussed above, in another embodiment, the processor 314 may be programmed to randomly send out the first wireless signal or second wireless signal to create different marble run outcomes as a matter of chance. Similarly, the processor 314 may be programmed to allow the user to send the first and/or second wireless signal upon completion of a gaming task running on the control transmitter 300. Many other variants that employ the control of the controllable module 500 can be envisioned for gaming and/or educational purposes.

Figure 6:
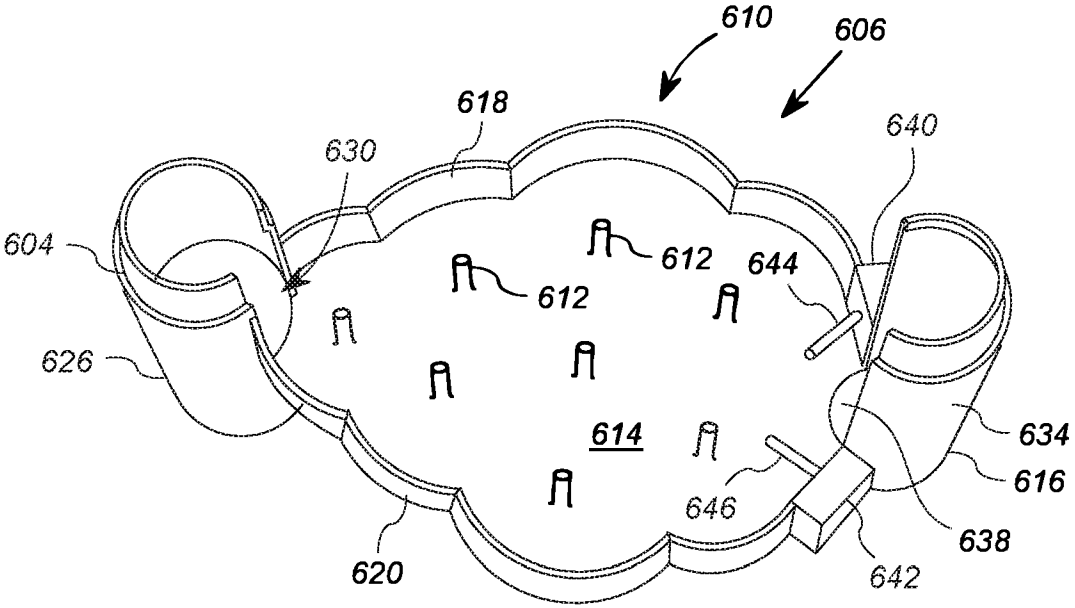
FIG. 6 shows to perspective view of an exemplary fourth controllable module according to the invention.

Another embodiment of a controllable module 600 is shown in FIG. 6. In this embodiment, the controllable module 600 resembles the prior art module 11D of FIG. 1. To this end, the controllable module 600 includes a track base 602 having travel region in the form of a wide platform 610 with spikes 612 similar to the wide platform 20 and spikes 22 of the module 11D of FIG. 1. The track base 602 also includes a vertical receiving tube 604 and continuous vertical tube 626 that are substantially identical in structure and function to, respectively, the receiving tube 412 and continuous vertical tube 426 of FIGS. 4A and 4B. The track base 602 further includes an exit tube 616 and associated vertical tube 634 that that are substantially identical in structure and function to, respectively, the exit tube 416 and vertical tube 434 of FIGS. 4A and 4B. The vertical tube 626 has an opening 630 through which the marble may pass from the vertical tube 626 to the wide platform 610. The vertical tube 634 at the exit has an opening 638 through which the marble may pass from the wide platform 610 to the exit tube 616.

The wide platform 610 includes a bottom surface 614 extending between opposing sidewalls 618 and 620. Each of the sidewalls 618 and 620 (and the bottom surface 614) extends from the vertical tube 626 that includes the receiving tube 604 to the vertical tube 634 containing the exit tube 616. The width of the platform 610 varies, but has at least a portion that is at least twice as wide, and preferably four or more times as wide, as the diameter of a standard marble suitable for use with the track. As with the other controllable (and non-controllable modules), the bottom surface 614 that receives the marble slopes downward from the receiving tube 604 to the exit tube 616.

In this embodiment, the controllable module 600 includes first and second actuators 640, 642, each of which operably connected to pivotally move a respective baffle 644, 646. The baffles 644, 646 may suitably be plates, planks or rods that are arranged in a manner similar to flippers of a traditional pin ball machine. To this end, the baffles 644, 646 are arranged to strike the marble to prevent the marble from rolling into the vertical tube 634 at the exit. In other words, actuating either baffle 644, 646 at a proper time can cause the corresponding baffle 644, 646 to rotate and drive the marble further away from the exit tube 616.

The actuator 640 in this embodiment is disposed on the sidewall 618, and the actuator 642 is disposed on the sidewall 620. Each of the actuators 640, 642 is operably coupled to pivotally drive the corresponding baffle 644, 646 from a rest position to an actuated position, and vice versa, along respective arcuate paths. The baffles 644, 646 are disposed on or above the bottom surface 614. The baffles 644, 646, extend inward toward each other from the respective actuators 640, 642, but pivotally sweep from a position angled towards the exit tube 616 (rest position, not shown), to a position angled towards the receiving tube structure 626 (actuated position, shown in FIG. 6). In the rest position, the marble may pass to from the platform 610 to the exit tube 616. In at least part of the travel from the rest position to the actuated position, the baffles 644 and 646 can extend toward each other sufficiently to prevent the marble from passing to the exit tube 616. Thus, a properly timed operation of the actuators 640, 642 can prevent the marble from reaching the exit tube 616. It will be appreciated, however, that in some embodiments, the baffles 644, 646 need not ever extend sufficiently to prevent the marble from passing to the exit tube 616.

To control the actuators 640, 642, the controllable module further includes wireless circuitry and a power source, not shown, but which may have a similar architecture as the wireless circuitry 208 and power source 210 shown in FIG. 3. In the embodiment of FIG. 6, however, the wireless circuitry is configured to cause actuation of two actuators 640, 642, instead of one. In this embodiment, the wireless circuitry operates the actuators 640, 642 responsive to receiving a suitable command signal from an external source, such as the control transmitter 300 of FIG. 3. In response to the command signal, the control circuit 304 causes both actuators 640, 642 to rotate the baffles 644, 646 to the actuated position (FIG. 6), hold that position for a predetermined amount of time (or not time), and then return to the rest position. Thus, a single command from the control transmitter 300 of FIG. 3 causes both baffles 644, 646 to move temporarily to the actuated position, and then return to the rest position.

It will be appreciated that, if desired, the actuators 640, 642 can be individually controlled, and/or controllable to hold the actuated position until a subsequent signal is received from the control transmitter 300. It will also be appreciated that the actuators 640, 642 may be located at other locations on the sidewalls 618, 620, and that more than two (or just one) baffle/flipper may be employed. It will also be appreciated that the actuators 640, 642 and baffles 644, 646 may be used on a track base having other shapes, as well as track bases without spikes 612.

Thus, the controllable module 600 includes yet another way the user may alter the path of travel of a marble in a track by allowing the user in real-time to strike the marble with the baffles 644, 646.

It is envisioned that one or more of the controllable modules 200, 400, 500 and 600 may be included with multiple passive modules, such as those shown in FIG. 1, in a kit. The control transmitter 300 may be a specialized device included within the kit. However, as discussed above, the control transmitter 300 may alternatively be any general portable computing device owned by the user, such as a smart phone, a tablet computer, or the like. In such a case, the software capable of performing the steps attributable to the control transmitter 300 herein would be in an application downloadable from a remote source (i.e. server) generally accessible to the public.

It will be appreciated that the above described embodiments are merely exemplary and that those of ordinary skill in the art may readily devise their own implementations and modifications that incorporate the principles of the present invention and fall within the spirit and scope thereof.

What is claimed is:

1. A method of operating a marble run, comprising:

a) providing a first input through a user interface of a wireless device;

b) responsive at least in part to receiving the first input, using the wireless device to transmit a first wireless control signal to a wireless receiver disposed on a marble run, the marble run comprising a plurality of physically interconnectable marble run modules, each module configured to retain a marble and guide travel of the marble through the module on at least a first surface, wherein the plurality of marble run modules includes at least a first controllable module; and c) using the first controllable module to perform an operation responsive to the wireless receiver receiving the first wireless control signal.

2. The method of claim 1, wherein the wireless device includes a processor executing a program, and wherein step b) further comprises:

using the processor executing the program to cause transmission of the first wireless control signal responsive at least in part to receiving the user input.

3. The method of claim 2, wherein step a) further comprises providing the first input including information identifying the first controllable module.

4. The method of claim 3, wherein the wireless control signal includes identification information and command information, the identification information corresponding to the first controllable module, and the command information corresponding to the operation.

5. The method of claim 4, wherein the command information includes information identifying a delay time, and wherein the method further comprises using the first controllable module to perform a second operation responsive to the wireless receiver receiving the first wireless control signal after the delay time after performing the operation.

6. The method of claim 2, wherein the wireless control signal includes identification information and command information, the identification information corresponding to the first controllable module, and the command information corresponding to the operation.

7. The method of claim 6, wherein the marble run further comprises a second controllable module.

8. The method of claim 7, further comprising using the processor to further execute the program to cause transmission of multiple signals as part of a sequence controlling multiple controllable modules.

9. The method of claim 2, wherein the wireless device comprises a portable wireless computing device, and the method further comprising downloading the program from a publicly available source.

10. A method of operating a marble run, comprising:

a) providing a first input through a user interface of a wireless device;

b) responsive at least in part to receiving the first input, using the wireless device to transmit a first wireless control signal to a wireless receiver disposed on a marble run, the marble run comprising a plurality of physically interconnectable marble run modules, each module configured to retain a marble and guide travel of the marble through the module on at least a first surface, wherein the plurality of marble run modules includes at least a first controllable module; and c) using the first controllable module to alter a travel path of a marble through the first controllable module responsive to the wireless receiver receiving the first wireless control signal.

11. The method of claim 10, wherein the first controllable module includes an actuator operably coupled to alter the travel path of the marble, and wherein step c) further comprises using the first wireless receiver to provide a first control signal to the actuator responsive to receiving a first wireless control signal.

12. The method of claim 11, wherein the wireless device includes a processor executing a program, and wherein step b) further comprises:

using the processor executing the program to cause transmission of the first wireless control signal responsive at least in part to receiving the user input.

13. The method of claim 12, wherein step a) further comprises providing the first input including information identifying the first controllable module.

14. The method of claim 13, wherein the wireless control signal includes identification information and command information, the identification information corresponding to the first controllable module, and the command information corresponding to the alteration of the marble path.

15. The method of claim 14, wherein the command information includes information identifying a delay time, and wherein the method further comprises using the first controllable module to perform a subsequent alteration of the marble path responsive to the wireless receiver receiving the first wireless control signal after the delay time after performing the alteration of the marble path.

16. The method of claim 15, wherein the marble run further comprises a second controllable module.

17. The method of claim 16, further comprising using the processor to execute the program to cause transmission of multiple signals as part of a sequence controlling multiple controllable modules.

18. The method of claim 12, wherein the wireless device comprises a portable wireless computing device, and the method further comprising downloading the program from a publicly available source.

19. The method of claim 11, wherein the first controllable module further includes a baffle having a first position and a second position, wherein the baffle is configured to direct the marble within the module in different directions based on whether the baffle is in the first position or the second position, and further comprising using the actuator to move the baffle from one of the first and second position to the other of the first and second position responsive to receiving the first control signal.

20. The method of claim 19, wherein the baffle includes a pivoting member, and wherein the actuator is configured to rotate the pivoting member to move the baffle between the first position and the second position.

* * * * *